US005138743A

United States Patent [19]

Hoffman

[11] Patent Number: 5,138,743

[45] Date of Patent: Aug. 18, 1992

[54] REFRIGERATOR DOOR CLOSING DEVICE

[75] Inventor: Charles J. Hoffman, Kentwood, Mich.

[73] Assignee: White Consolidated Industries, Inc., Cleveland, Ohio

[21] Appl. No.: 719,320

[22] Filed: Jun. 21, 1991

[51] Int. Cl.[5] ..... E05F 3/20

[52] U.S. Cl. ..... 16/303; 16/DIG. 13

[58] Field of Search ..... 16/303, 304, DIG. 7, 16/DIG. 13, DIG. 17

[56] References Cited

U.S. PATENT DOCUMENTS

| | | | |
|---|---|---|---|
| 571,133 | 11/1896 | Hoffman | 16/303 |
| 1,808,901 | 6/1931 | McGerry et al. | 16/303 |
| 2,604,654 | 7/1952 | Anderson | 16/303 |
| 3,452,387 | 10/1967 | Jerila et al. . | |
| 3,628,845 | 12/1971 | Grimm . | |
| 4,215,449 | 8/1980 | Loikitz | 16/303 |

FOREIGN PATENT DOCUMENTS

| | | | |
|---|---|---|---|
| 0626031 | 10/1961 | Italy | 16/303 |
| 0008620 | of 1840 | United Kingdom | 16/303 |

*Primary Examiner*—David Jones

*Attorney, Agent, or Firm*—Pearne, Gordon, McCoy & Granger

[57] ABSTRACT

A refrigerator cabinet has a door closing device integral with a door top hinge member to fit within the door. The mechanism includes a bearing member secured to the door and a cam member nonrotatably secured to the hinged pin below the bearing member and having a cam follower engaging a cam surface on the lower face of the bearing member. A spring is secured around the lower end of the hinge pin to force the cam member upward against the bearing member and its cam surface, with the cam surface and a cam follower on the cam member being configured to provide a closing bias when the door is near the closed position and detent positions when the door is opened a predetermined amount.

4 Claims, 3 Drawing Sheets

REFRIGERATOR DOOR CLOSING DEVICE

BACKGROUND OF THE INVENTION

This invention relates to door closing devices and more particularly to devices associated with a door hinge that provide not only a closing force when the door is near the closed position to insure positive door sealing, but also positive detent positions when the door is open at one or more predetermined angles.

In the case of household refrigerators and freezers, it has been the practice of providing positive door closers on certain models such as side-by-side units because of problems of insuring positive door closing on these models. Present refrigerator designs, for reasons of safety, utilize a magnetic rubber gasket to hold the door closed without the use of any mechanical look or latch. While these gaskets hold the door tightly closed, they can provide this force only when the door is actually in the closed position. If the door does not reach the position where the magnetic force can pull the door fully closed, it will remain slightly open allowing the cold air to escape. If this happens there is the danger that the interior will warm excessively as well as cause high energy use to run the refrigerating system.

While some closing force can be obtained by tilting the top of the refrigerator to the rear, it has been found particularly necessary to provide additional closing forces on side-by-side models because the doors have relatively low closing inertia even when the internal door shelves are full, because the doors tend to be quite narrow for a given size. Because of the closing force, it has also been desirable to provide detent positions when the door is open at, for example, at 90 and 150 degree positions. Because an external closer would interfere with access to the refrigerator as well as be vulnerable to damage, it has been recognized that the closer mechanism must be relatively hidden and therefore built into the door hinges.

One type of closer has utilized the weight of the door to provide the closing force. As shown in U.S. Pat. No. 3,628,845, granted Dec. 21, 1971, the lower hinge plate has a fixed bearing member around the hinge pin that has a number of recesses and projections on its upper surface which are engaged by mating projections and recesses on the lower surface of the upper bearing member which is fixed to the door. Thus as the door is opened and closed, the two bearing members act as a cam and cam follower under the biasing force of the weight of the door to produce rotating forces tending to rotate the door in one direction or the other. This arrangement requires that the door move vertically to provide the rotating force which then varies with the contents of the door shelves. Furthermore, the bearing members tend to collect dirt which may affect the operation of the bearings as well as excessive wear.

Another type of door closer is that shown in U.S. Pat. No. 3,452,387 granted Jul. 1, 1969, which is particularly adapted to be mounted entirely within the door adjacent to the upper hinge. The unit includes a rotatable radial cam journaled in one end of the housing and adapted to receive a splined hinge pin secured to the hinge bracket on the refrigerator cabinet. The radial cam works with a spring-loaded roller to provide a biasing force on the cam and provide not only detents for open door positions, but also a closing force when the door is near the closed position. This unit is relatively expensive and difficult to repair and replace, and is therefore been used only in doors that have movable fiberglass insulation.

SUMMARY OF THE INVENTION

The preferred embodiment of the present invention provides a door closer which can be easily mounted within a cylindrical cavity within the door such as may be defined by a foamed-in-place insulation within the door structure. The entire unit may be made integral with a hinge structure such as the top hinge bracket to be capable of being mounted or removed as a unit with the hinge bracket.

Preferably the door closer includes a hinge bracket having an integral hinge pin extending from the bracket a spaced distance from and parallel to the front face of the cabinet. The hinge pin extends into the door through an opening on the top surface and carries an upper bearing member which is rotatable on the hinge pin but which is non-rotatably secured to the door member, preferably by an integral extending arm extending across the door upper surface and carrying another projection which fits into a hole in the top surface of the door spaced away from the hinge pin. Inside the door and below the bearing member is a cam member also carried on the hinge pin by a spline-like connection so that it is held from rotating on the hinge pin that is free to slide vertically within the cavity and the door insulation. Below the cam member is a helical spring secured at the bottom end of a retainer mounted on the end of the hinge pin, and serving to bias the cam member upwardly into contact with the bearing member. The lower face of the bearing member and upper face of the cam member have cam and cam follower surfaces formed to provide positive detents at various angular positions of the door. According to the preferred embodiment of the invention, the cam and bearing member provide two positive detents about 180° apart if door rotation, and or so positioned axially that one of the position is located when the door is open approximately 150°, so that the other position is actually located where the door would be if it could turn 30° past the closed position. Since the door has not reached the stable position when it is closed, the spring acting on the cam member and bearing member continues to provide a biasing force forcing the door into the closed position. When the door is opened, the cam member rotates past the bearing member so that when the door is rotated well past the 60° open position, the cam member and bearing member now start to produce a biasing force tending to open the door to its full open position of 150°. To the extent that the bearing member cam member have flat surfaces, no biasing force would be applied to the door if those surfaces are in alignment and various detent positions could be obtained by changing the configuration of the cam member and bearing member.

Another feature of the present invention allows the same unit to be used on both the left and right sides so that it may be used on single door refrigerators when the door hinge is shifted from one side to the other and also can be used for both the left hand or freezer door and right hand or food compartment door on side-by-side refrigerators. By having the detent position such that the fully closed position has the projecting arm generally bisecting the hinge bracket, the hinge bracket can be arranged in one side or the other by having the arm swung the necessary 30° off-center in one direction or the other depending upon the side of the refrigerator where the closer and hinge bracket are used.

Because the closure mechanism is arranged vertically along the hinge pin, it can fit entirely within a cylindrical recess in the door so that the closure mechanism and upper hinge bracket can be removed simply by removing the bolts or screw holding the hinge bracket on the top wall of the refrigerator cabinet and simply withdrawing the mechanism from the door. The unit can easily be replaced by holding the door in a position where the closer is stable and then inserting the mechanism into the opening and the top surface of the door with the projection on the arm of the upper bearing member fitting into the opening on the top wall of the door panel to properly position the bearing member for the detent positions. Thus, it is only necessary to insert and tighten the bolts holding the bracket to the top wall of the cabinet to completely re-install the hinge member and closer unit.

DETAILED DESCRIPTION OF THE PREFERRED EMBODIMENT

Figure 1:
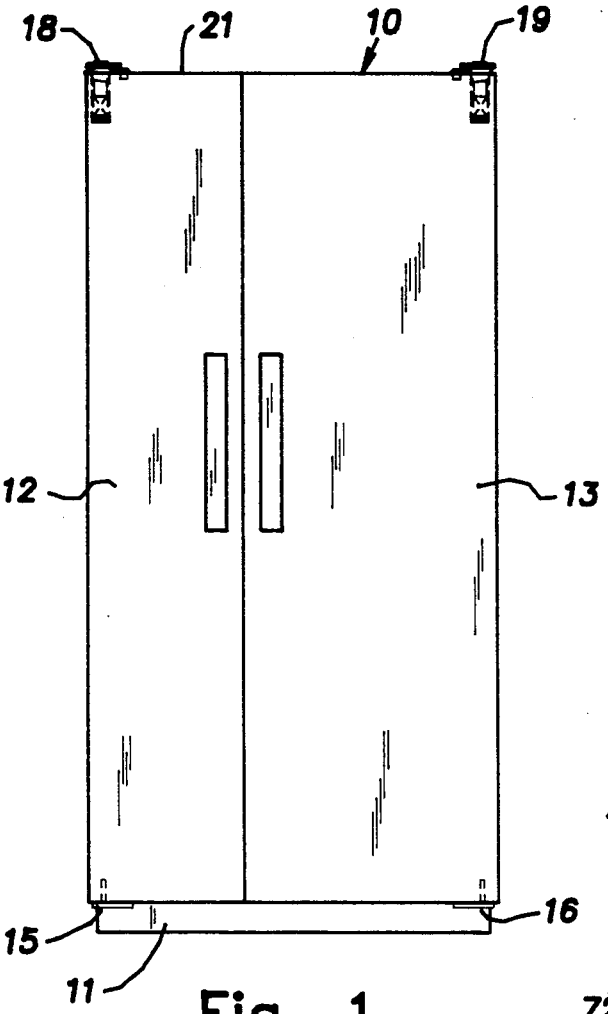
FIG. 1 is a front elevational view of a side-by-side refrigerator incorporating the preferred embodiment of the present invention.
Figure 5:
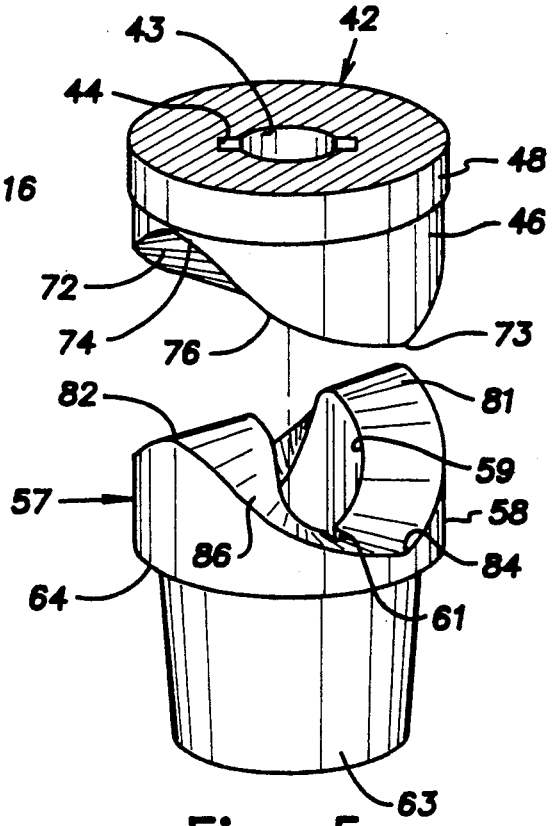
FIG. 5 is a perspective view of the upper bearing member and cam member in spaced apart positions.

Referring now to the drawings in greater detail, FIG. 1 shows a typical refrigerator 10, in this case of the side-by-side type, having a open faced cabinet 11 closed off by a freezer door 12 on the left hand side and a larger food compartment door 13 on the right hand side. The doors 12 and 13 are supported on their outer lower corners by lower hinges 15 and 16, respectively which are mounted directly on the cabinet 11 and serve not only as radial bearings to position the door with respect to the cabinet, but also as thrust bearings to take the vertical load and weight of the door and its contents. At the upper outer corners are upper hinges 18 and 19, respectively which serve not only to position the upper corner of the door to give proper hinge action but also to act as closer members to bias the door to a fully closed position, and also provide a detent in the open position. According to an important feature of the invention, the upper hinges 18 and 19 are not only self contained with all of the mechanism mounted on the hinge, but also are preferably identical in structure even though as mounted they provide opposite actions on the respective doors.

Figure 2:
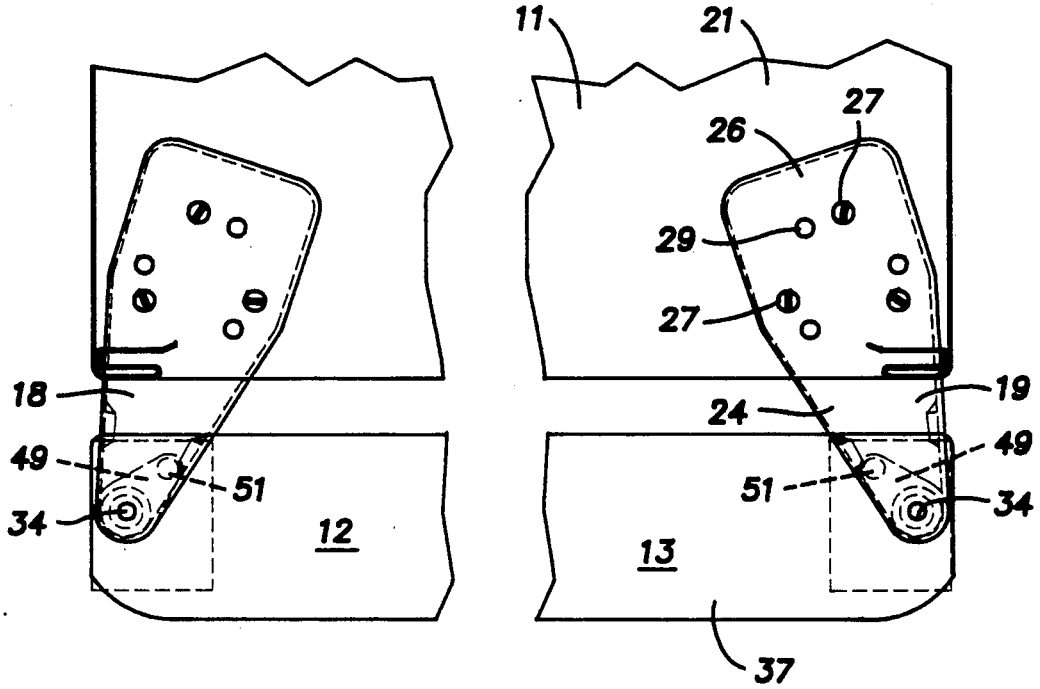
FIG. 2 is a top plan view with the center section broken away of the refrigerator of FIG. 1.
Figure 3:
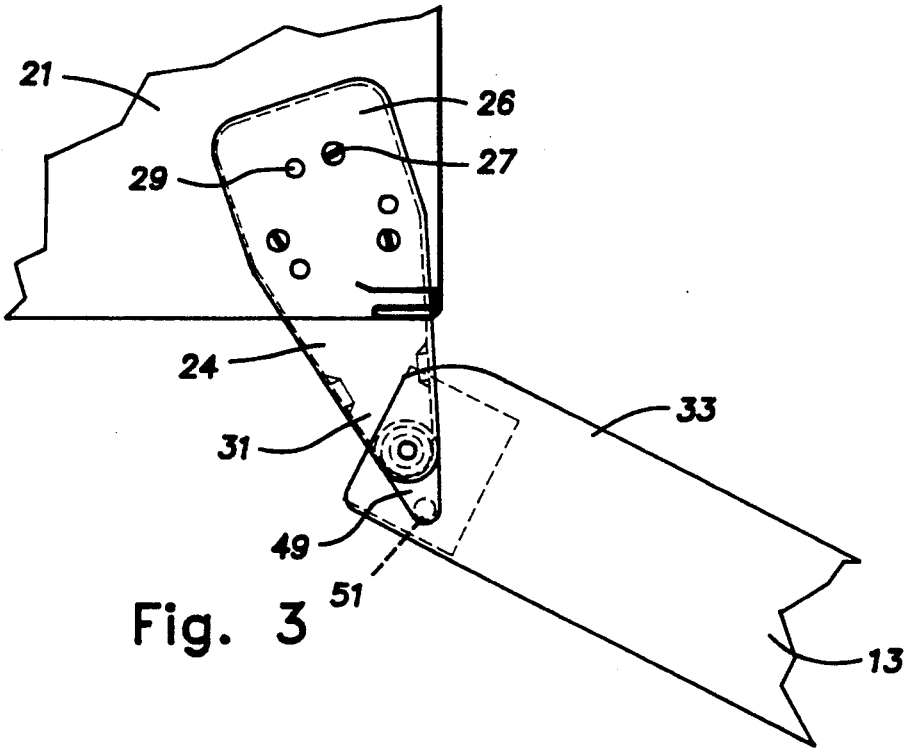
FIG. 3 is a view similar to the right hand portion of FIG. 2 showing the food compartment door in the open detent position.
Figure 4:
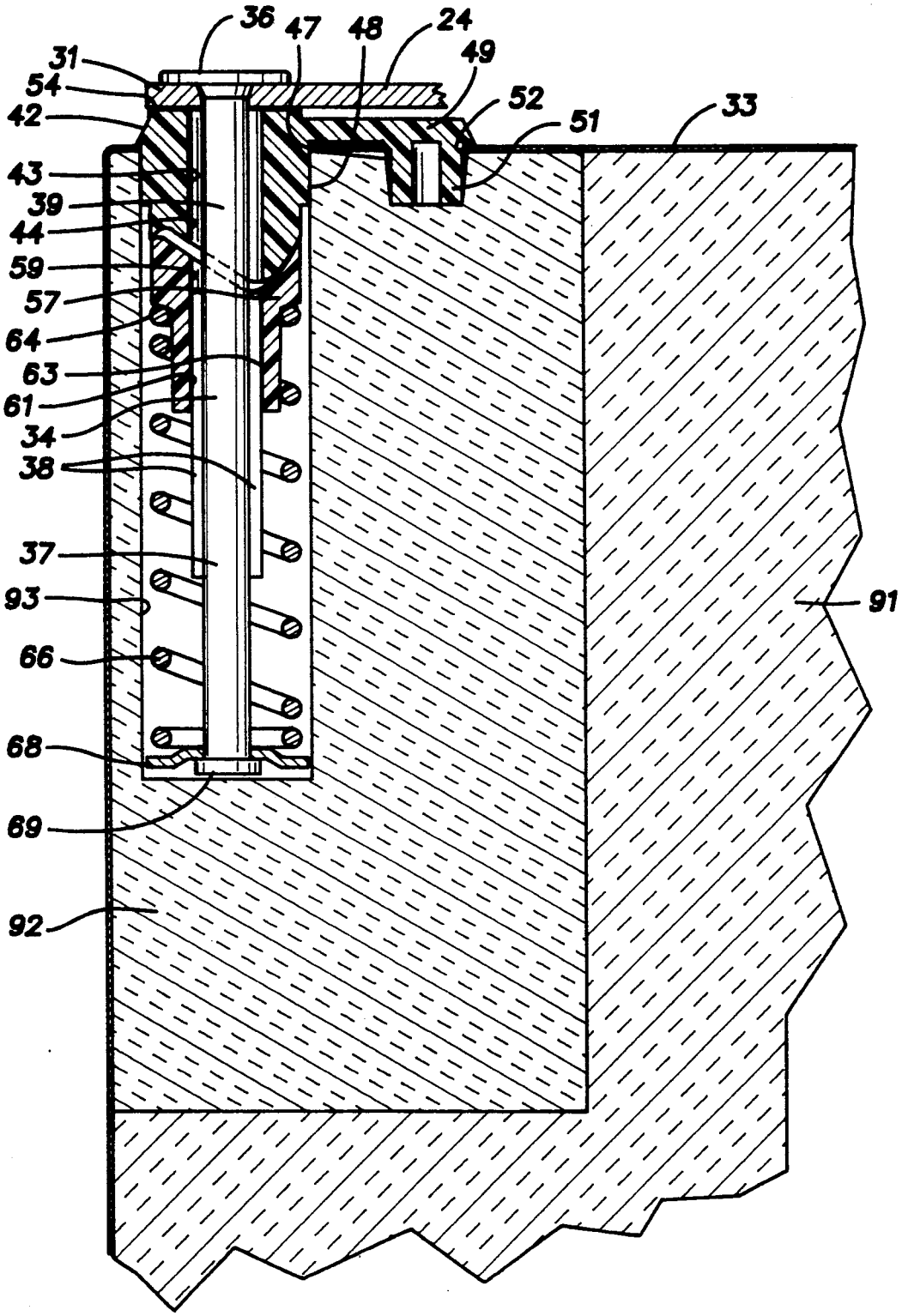
FIG. 4, is an enlarged cross-sectional view of the door closer mechanism.

The upper hinges 18 and 19 are secured on the top wall 21 of cabinet 11 as best shown in FIGS. 2 and 3. Each of the hinges includes a hinge bracket 24 having a base portion extending along the top wall 21 and held in place by suitable screws or bolts 27. As shown in FIG. 2, each of the bracket bases 26 has another set of holes 29 not used by the screws 27 but used when the base is placed in the opposite position so that one set of holes is used when the bracket is mounted on one side of the refrigerator and the other set is used when it is mounted on the other side. The hinge bracket 24 includes a tip portion 31 extending over a door top wall 33 and mounting hinge pin 34 which defines the hinge axis and is rigidly and non-rotatably secured to the tip 31 and has a head 36 extending on the upper side of the tip and the shank 37 extending downwardly through the adjacent door as shown in FIG. 4. The hinge pin shank 37 has a lower portion 38 having vertically extending splines thereon and a smooth cylindrical upper bearing portion 39 between the spline portion 38 and the hinge bracket tip 31.

A bearing member 42 is located on the upper end of shank 37 and has a bore 43 adapted to make rotating bearing contact with a bearing portion 39 to serve as the upper bearing for the door. Bore 43 includes a pair of parallel grooves 44 adapted to pass over the splines 38 during assembly, but after assembly the grooves serve no further purpose since they actually interrupt the bearing portion of bore 43 in engagement with the shank 37. The bearing member 42 includes an enlarged body portion 46 having a cylindrical outer wall 48 adapted to make a snug fit within the hole or opening 47 in the door top wall 33 to radially position the bearing member 42. Since the hinge pin 34 is fixed with respect to the cabinet, and the bearing member 42 rotates with the door, it is necessary to prevent rotation of the bearing member 42 in the opening 47. While this could be accomplished by making the parts non-circular, it is most conveniently done by means of having a projecting arm 49 extending from the body 46 over the door top wall 33 a spaced distance from the hinge axis. At its end, the arm 49 terminates in a downwardly extending projection 51 fitting within a smaller second hole 53 in the door top wall. Thus, by positively positioning the arm 49 against rotation, the bearing member 42 is fixed with respect to the door. It should also be noted that the bearing member 42 carries a flat top surface 54 which may engage the underside of the bracket tip 31 to limit upward movement of the door, although this is normally not a load bearing engagement. If desired, where spacing requires it, suitable shims may be placed between the top surface 54 and the hinge bracket.

Below the bearing member 42 is located a cam member 57 having an enlarged body portion 58 and a bore 59 adapted to pass over the hinge pin 34. Bore 59 includes vertically extending grooves 61 which ride along the splines 38 to allow vertical sliding movement of the cam member 57 along the hinge pin 34, but positively prevent rotation to ensure that the cam member 57 remains angularly fixed at all times with respect to the refrigerator cabinet. At its lower end, cam member 57 carries a reduced diameter shank portion 63 which joins the body portion 58 at radially extending shoulder 64. A helical compression spring 66, preferably having closed and grounds ends to provide a large bearing area, fits around the lower end of the hinge pin 34 and over the reduced diameter shank 63 to bear at its upper end against shoulder 64. The lower end of spring 66 is fixed with respect to the hinge pin and abuts against a washer-like retainer 68 which fits over the tip of the hinge pin 34 which is then formed into an enlarged head 69 to positively hold the retainer 68 in place axially with respect to the hinge pin.

In order to provide the necessary forces on the door, there are provided interacting cam and cam follower surfaces on the bearing member 42 and cam member 57. Thus, a cam follower surface 72 is formed around the lower periphery of the bearing member 42 in the form of a face cam having a pair of projecting lobes 73 180° apart, interspaced by higher base portions 74 and connected by means of ramp portions 76 on either side of the lobes 73. Thus, the surface 72 is basically symmetrical to have two projecting lobes 73 180° apart and so positioned with respect to the door as determined by the position of the arm 49 and hole 52. Cooperating with the cam follower 72 is a cam surface 81 formed on the top face of cam member 57 which is urged into engagement with the lobe 73 by the force of the helical spring 66. Thus, the cam member 57 moves vertically along the hinge pin 34 under the force of the spring without rotation and depending upon the shape of the cam surface 81, therefore tends to apply a rotational force to the lobe 73 to cause the door to rotate in one direction or another.

According to the preferred embodiment of the invention, the cam surface 81 is formed with a pair of lobes 82 also spaced 180° apart interspaced by base portion 84 and connected by ramp portions 86 and thus in effect may be a mirror image of the cam follower surface 72. This arrangement will provide two positive detent positions 180° apart when the cam follower lobe 72 is aligned with the base portion 84 on cam surface 81. When the lobe 73 is rotated in either direction, as it rides up the ramp portions 86, a biasing force will be applied to rotate the door in a direction where the lobe 73 engages the base portion 84. Depending upon the tips of the two lobes 82 and 73, there may be a dead point when they are in opposition but this is usually placed at a position where the door is not normally held.

In order to hold the door in the closed position, it is necessary that the align position be in a rotational point beyond the actual closed position and preferably this would involve an additional rotation of the door between 20° and 30° beyond the actual closed position to continue to apply a closing biasing force in addition to that provided by the magnetic gaskets. Thus, when the door is in a closed position, it will be seen that the lobe 73 ride a short distance up and adjacent ramp portion 86 and cam surface 81 to ensure that a continuous force is applied. Since the other detent position 180° apart from the beyond closed position would then lie between 150° and 160° open such as shown in FIG. 3, this will also be a positive detent position with the lobe 73 interengaging the base portions 84 of cam 81 so that the cam member 57 is at the highest position along the hinge pin 34.

As best shown in FIGS. 2 and 3, the hinge brackets 24 and the bearing members 42 are positioned so that when the arm 49 is in alignment with the bisector through the hinge bracket 42, the bearing member 42 and cam member 57 are in a positive detent position. Thus, when the hinge bracket is positioned in either of the two positions shown in FIG. 2 the bearing member 42 is offset to one side or the other as appropriate away from the positive detent position so it can function as a closer in a identical but mirror image manner for both of the doors.

The above assembly is particularly adapted for use in foam doors because it is easily removed or replaced from the door without affecting the foam insulation or requiring any other disassembly operation on the door itself. As shown in FIG. 4, when a foam insulated door is used, the entire space in the door is filled with an insulating foam 91. However, before that is done, a suitable preformed foam block 92 may be inserted inside the door and held in place by suitable adhesive means and after the insulation 91 has been poured in the door and allowed the foam in place, it will firmly hold the block 92 in position. By providing the block with a preformed cylindrical recess 93, it is simple to insert the complete closure as a unit into the recess 93 and rotate the bracket until the projection 51 is fitted into the hole 52 to ensure that bearing member 42 is in the correct rotational position for the door. Then, when the door is held in a position such as the open detent position of FIG. 3, it is only necessary to tighten the screws 27 to hold the hinge bracket base 26 in place on the cabinet top 21 to fully assemble the door on the refrigerator.

Although the disclosed embodiment as shown a door having only two detent positions, it is recognized that the cam member 57 may be formed having a different cam surface providing other detent positions engageable by the cam follower lobe 73 or that this configuration can be reversed between the cam and cam follower surfaces as desired to provide detents at any other door position desired.

Although the preferred embodiment of the invention has been shown and described in detail, it is recognized that various modifications and rearrangements may be resorted to without departing from the scope of the invention as defined in the claims.

What is claimed is:

1. A combined hinge and closing device for a door hinged on the face of a cabinet, said hinge including a hinge bracket secured to said cabinet to project from said face, a hinge pin secured to said bracket and extending parallel to and spaced from said face to define a hinge axis, a bearing member nonrotatably secured to said door and having an aperture rotatably receiving said hinge pin, said bearing member having an end face and a cam surface on said end face extending arcuately with respect to said hinge axis, a cam member nonrotatably carried on said hinge pin and slidable axially thereon, said cam member having a cam follower engageable with said cam surface, and a spring biasing said cam follower toward said cam surface to produce a force on said door tending to move said door toward a position predetermined by said cam surface, said bearing member having a projecting arm extending over said door and secured to said door a spaced distance from said hinge axis by a projection on the end of said arm extending into an opening in said door.

2. A combined hinge and closing device for a door hinged on the face of a cabinet, said door having a top wall and a recess on said top wall, said hinge including a hinge bracket secured to said cabinet to project from said face over said recess, a hinge pin secured to said bracket and extending into said recess parallel to and spaced from said face to define a hinge axis, a bearing member nonrotatably secured to said door in said recess and having an aperture rotatably receiving said hinge pin, said bearing member having an end face on its lower end and a cam surface on said end face extending arcuately with respect to said hinge axis, a cam member nonrotatably carried on said hinge pin in said recess and slidable axially thereon, said cam member having a cam follower engageable with said cam surface, and a helical spring surrounding said hinge pin and having one end abutting with said cam member and having the other end abutting with a retainer secured to said hinge pin, said spring biasing said cam follower toward said cam surface to produce a force on said door tending to move said door toward a position predetermined by said cam surface.

3. A combined hinge and closing device as set forth in claim 2, wherein said device is a integral unit secured to said hinge bracket to be removable and replaceable as a unit with said hinge bracket.

4. A combined hinge and closing device as set forth in claim 2, wherein said bearing member is prevented from rotation with respect to said door by a projecting arm secured to said door top wall.

* * * * *